US005297643A

United States Patent [19]

Montgomery, Jr. et al.

[11] Patent Number: 5,297,643

[45] Date of Patent: Mar. 29, 1994

[54] COLD HEADED CENTER VACUUM DRILL BIT

[75] Inventors: Robert H. Montgomery, Jr., Everett; Daniel C. Sheirer, Bedford, both of Pa.; James E. Elam, Livonia; Paul E. Ewing, Farmington Hills, both of Mich.

[73] Assignees: Kennametal Inc., Latrobe, Pa.; NSS Industries, Plymouth, Mich.

[21] Appl. No.: 791,755

[22] Filed: Nov. 12, 1991

Related U.S. Application Data

[63] Continuation-in-part of Ser. No. 630,139, Dec. 19, 1990.

[51] Int. Cl.[5] ..... E21B 10/46

[52] U.S. Cl. ..... 175/393; 175/420.1

[58] Field of Search ..... 175/393, 410, 420.1, 175/426, 432; 76/108.4

[56] References Cited

U.S. PATENT DOCUMENTS

| | | | |
|---|---|---|---|
| 2,141,753 | 12/1938 | Hufferd et al. | 29/152 |
| 2,748,464 | 9/1949 | Kaul | 29/535 |
| 2,748,932 | 6/1956 | Kaul | 207/6 |
| 2,829,431 | 4/1958 | Brauchler | 29/535 |
| 3,631,706 | 1/1972 | Archer et al. | 72/354 |
| 4,078,415 | 3/1978 | Koch et al. | 72/356 |
| 4,245,846 | 1/1981 | Andrews | 279/46 |
| 4,313,506 | 2/1982 | O'Connell | 175/410 |
| 4,485,655 | 12/1984 | Ewing | 72/68 |
| 4,492,278 | 1/1985 | Leighton | 175/410 |
| 4,603,751 | 8/1986 | Erickson | 175/410 |
| 4,627,665 | 12/1986 | Ewing et al. | 299/79 |
| 4,633,959 | 1/1987 | Knox | 175/410 |
| 4,711,312 | 12/1987 | Leibee et al. | 175/393 |

OTHER PUBLICATIONS

Metals Handbook, 8th Edition, vol. 4, "Forming" American Society for Metals, pp. 465–475.

Metals Handbook, 9th Edition, vol. 14, "Forming and Forging" ASM International, pp. 291–298.

*Primary Examiner*—William P. Neuder

*Attorney, Agent, or Firm*—John J. Prizzi; Larry R. Meenan

[57] ABSTRACT

A drill bit for drilling holes in a work surface including a hard wear-resistant insert and a metal body including a top working surface of an irregular surface configuration having a slot for retaining the hard wear-resistant insert. The body having a metal grain structure substantially parallel with the contour of the body. In a preferred embodiment the body is formed by cold-heading.

17 Claims, 8 Drawing Sheets

COLD HEADED CENTER VACUUM DRILL BIT

This is a continuation-in-part of copending application(s) Ser. No. 07/630,139 filed on Dec. 19, 1990.

FIELD OF THE INVENTION

This invention relates to drill bits. More particularly, this invention relates to cold headed center vacuum drill bits.

DESCRIPTION OF THE RELATED ART

A drill bit is typically mounted on a working end of an elongated, hollow drill rod which is adapted to be connected to a source of rotary power. The drill bit and drill rod may then be used for drilling holes in a work surface such as a rock strata in the roof of a mine entry for installing roof bolts or receiving explosive charges.

The drill bit which is secured to the working end of the drill rod includes a cylindrical body having a top working surface to which is attached an insert made of a hard wear resistant material, such as cemented carbide or the like. A pair of dust collection openings are positioned beneath the insert in communication with an axial bore extending through the bottom end of the drill bit.

Because drilling in rock formations produces large quantities of drill cuttings and dust, it has been the practice to remove these cut materials through the dust collection openings within the drill bit body and then through the hollow drill rod. The cut material is drawn into the drill bit body and through the hollow drill rod using a suitable vacuum pump, or alternatively, by forcing a coolant liquid up through the drill rod and out through the openings to thereby wash away the cut materials and dust.

It is known to manufacture a drill bit body for drilling holes in the roof of a mine entry by performing a series of complex machining operations on a cylindrical steel blank of a limited size. More particularly, it has been the practice to manufacture a drill bit body by initially providing a cylindrical steel blank and then drilling and countersinking a bore hole axially within the center of the blank. One or two broach relief rings are then machined out of the interior axial bore followed by hex broach of the inside diameter bore after which two sides of the blank are milled to form two planar side surfaces. Next, the top working surface of the blank is machined to a cone shape having alternating tapered heel surfaces and compression surfaces to allow dust and the like to flow around the bit body as the drill bit penetrates into the rock strata. Dust collection openings as previously described, are then drilled through the side surfaces. Next, a hole is drilled below the openings to provide a securing means such as a 5522 chuck and 9240 clip obtainable from Kennametal Inc. to maintain the bit on the drill steel. Finally, a transverse slot is machined within the top working surface diagonally between the tapered heel surfaces and compression surfaces to provide a means for retaining the cemented carbide insert within the drill bit body.

The machining operations required to manufacture a drill bit body are complex and have been found to limit the size, shape and performance characteristics of the drill bit which may be manufactured. For example, the marginal edges formed in the machining of the planar side surfaces of a drill bit body are typically sharp which interferes with air flow and drill dust removal.

Furthermore, the formation of a drill bit body by machining removes more of the grain structure than a drill bit body formed in part by cold-heading. It will be appreciated that the increased removal of metal grain structure from a drill bit body by machining weakens the structural integrity of the drill bit thereby adversely affecting the performance of the drill bit. The various machining operations required in the manufacture of a drill bit body represent a substantial portion of the overall cost of the finished product. Accordingly, it would be advantageous if a new method of manufacturing a drill bit body were found that overcomes the problems of the prior art.

One attempt at manufacturing a new type of drill bit body is by casting. The casting of a drill bit body has been found to eliminate some of the machining steps required in the manufacture of a drill bit. However, such cast center vacuum bits suffer from poor casting integrity and strength which may cause premature failure of the drill bit. Moreover, these cast center vacuum bits further suffer from the disadvantage of high cost associated with the investment casting process.

Consequently, a need exists for an improved process and design to eliminate as many of the machining steps in the production of a drill bit body as possible without the sacrifice of certain desired mechanical properties.

To alleviate the aforementioned problems, we have invented a novel drill bit body design and a novel process for manufacturing a drill bit body. The present invention eliminates the necessity for machining of the side surfaces of the drill bit body to form the planar side surface, machining of the top working surface and broaching of the interior hex of the central bore of the drill bit body. The present invention also allows for the elimination of the steps of drilling and countersinking an interior axial bore and machining of one or two broach relief rings. It will be appreciated that the elimination of the broach relief rings has the advantage of providing increased strength to the drill bit body. Further advantages of the present invention are that the drill bit body may be finished more quickly and economically resulting in a stronger steel drill bit body due to forging flow lines (grain structure) which follow the contour of the drill bit body. The drill bit body in accordance with the present invention exhibits superior toughness relative to a machined bit body and eliminates machined sharp corners in the broaching hex internals to provide a consistent drill bit body thickness which gives added strength to the insert slot. The drill bit body may be of substantially uniform diameter or, in accordance with another embodiment of the invention, the exterior side surfaces of the drill bit body may taper from the top working surface toward an opposing end of the drill bit body. The degree of taper may be varied as desired.

As used herein the term "taper" refers to a linear or nonlinear widthwise dimensional decrease along the length of the drill bit body.

It will also be appreciated that because of the present invention, lower alloyed steels may now be used due to the increased strength imparted to the bit body. With the use of lower alloyed metals further machining of the bit body is made easier. For example, complex and simple insert slot designs of varying size, position and number may be easily formed within the top of the drill bit body.

Further advantages of the present invention are that complex outer body configurations to improve air flow around the top working surface of the bit body resulting in improved evacuation are now possible and varying socket configurations to secure the drill bit body to a drill rod may now be easily and economically manufactured. For example, in accordance with one embodiment of the present invention, a tapered drill bit body provides additional strength to the top working surface and improved air and material flow during drilling.

SUMMARY OF THE INVENTION

Briefly, according to this invention, there is provided a center vacuum drill bit having a body including a top working surface and a process for making the drill bit.

The drill bit produced in accordance with the present invention includes a hard wear-resistant insert and a metal body having a top working surface of an irregular surface configuration and a slot for retaining the hard wear-resistant insert. The body of the drill bit is preferably formed by cold-heading to provide a metal grain structure substantially parallel with the contour of the body. The drill bit body may be of substantially uniform diameter or, in accordance with another embodiment of the invention, the drill bit body may taper from the top working surface toward the opposing end of the drill bit body. The degree of taper may be varied as desired.

The drill bit body includes an interior axial bore extending upwardly through an end of the body, at least two opposing recessed inverted C-shaped planar side surfaces exterior of the body extending parallel to a central axis of the body, or tapering from the top working surface toward an opposing end of the drill bit body, and at least two opposing dust collection openings. Each of the openings extends through a corresponding planar side surface and is in communication with the axial bore. The drill bit openings may be generally oval and positioned at an angle of approximately 45 degrees with respect to the central axis or the drill bit openings may be circular. A pair of oppositely disposed upstanding members arcuate in cross-section extend between the openings.

The openings define a pair of oppositely disposed transverse curved shoulder portions at the lower marginal edges thereof.

The top working surface of the drill bit body includes an alternating first pair of oppositely disposed tapered heel surfaces and a second pair of oppositely disposed tapered compression surfaces. A slot extends transversely between the alternating pair of tapered heel surfaces and compression surfaces to receive the insert.

Each of the tapered heel surfaces is of a slightly convex conical shape extending downwardly and outwardly in a direction away from the central axis. Each of the tapered compression surfaces is of a concave depression pie shape extending downwardly and outwardly toward the associated opening adjoining the planar side surface and inclined at an angle of inclination greater than 20 degrees with respect to the central axis.

In one embodiment of the present invention the tapered compression surfaces extend downwardly and outwardly to curved marginal edges which terminate at the openings to promote improved flow of air and dust and debris for discharge and removal through the axial bore.

The process for making the drill bit having a body including a top working surface from a blank having a forward end and a rearward end broadly includes cold-heading the blank to form the drill bit body and then forming a slot within the top working surface and dust collection openings within the body.

More particularly, the process of cold-heading includes the steps of shaping the blank to a uniform cylindrical size, molding the forward end of the blank into the shape of a truncated cone, punching a centering means within the rearward end and forward end of the blank, forming at least two opposing side surfaces having tapered scallop stress release surfaces within the sides of the blank, shaping a top working surface to form alternating tapered conical heel surfaces and tapered conical compression surfaces, and forming an axial bore concentric with the centering means.

The punching step includes punching a first annular recess within the rearward end of the blank and punching a second annular recess of a diameter larger than said first annular recess within said rearward end of said blank and forming a depression within the forward end of said truncated cone.

A slot is then formed transverse to the central axis between each pair of alternating tapered conical heel surfaces and tapered conical compression surfaces to receive the insert and the dust collection openings are formed in communication with the axial bore within the body.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
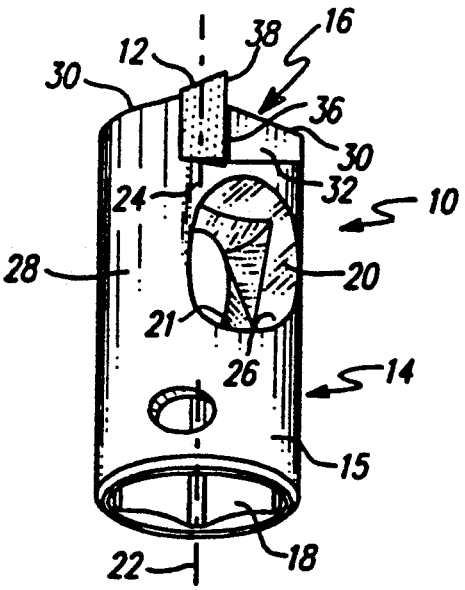
FIG. 1 is a perspective view of a drill bit made in accordance with the present invention.
Figure 2:
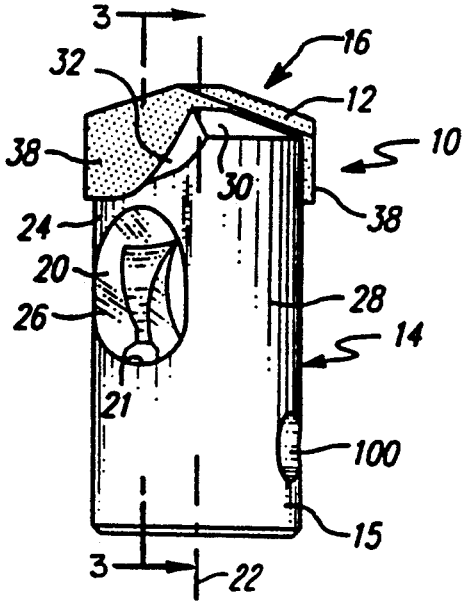
FIG. 2 is a front view of a drill bit made in accordance with the present invention.
Figure 3:
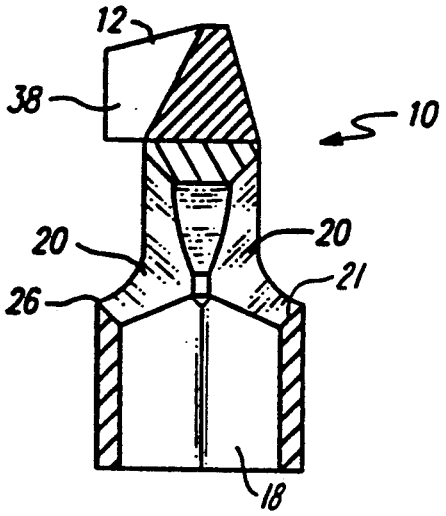
FIG. 3 is a cross sectional view of the drill bit of FIG. 2 taken along line 3—3.

In the following description, like reference characters represent like elements. Also, in the following description, it is to be understood that such terms as "forward," "rearward," "upward", "downward", "inward", "outward" and the like are words of convenience and are not to be construed as limiting terms.

Referring now to the figures, FIGS. 1, 2, 20, 21, and 26–29 show a drill bit 10 including a body 14 having a top working surface 16 to which is secured an insert 12 adapted for use with a drill rod (not shown) for performing drilling operations in various types of strata including irregular, hard, soft and medium rock formations. The drill bit 10 may be attached to the drill rod by attachment means such as a snap connection end (not shown) or any other suitable attachment means known to one skilled in the art.

The drill bit body 14 comprises a unitary one piece member formed by cold heading. It will be appreciated that because the drill bit body 14 is formed by cold heading, the drill bit has a metal grain structure that is substantially parallel with the contour of the drill bit body. A drill bit body 14 having a parallel metal grain structure provides a drill bit of improved strength and lower cost than prior drill bits manufactured by machining.

As shown in FIGS. 1, 2, 20, 21, and 26–29 the drill bit 10 includes an elongated cylindrical body 14 having a top working surface 16. Extending upwardly through an opposing end 15 of the drill bit body 14 is an interior axial bore 18 of hexagonal cross sectional shape. It will be appreciated that the interior axial bore 18 may be of most any suitable cross sectional shape and length to define a female socket to receive in interlocking relationship a male end of the rotating drill rod and transfer rotational force from a drive means (not shown) to the drill bit 10.

The drill bit body 14 may be of substantially uniform diameter, FIGS. 1, 2, 20 and 21 or, in yet another embodiment of the invention, the drill bit body may taper from the top working surface 16 toward an opposing end 15 of the drill bit body, FIGS. 26–29. As used herein the term "taper" refers to a linear or nonlinear widthwise dimensional decrease along the length of the drill bit body.

The degree of taper of the drill bit body 14 may vary. For example, the taper of a drill bit body 14 of approximately 2 inches in length may vary about 0.004 in. in diameter from the top working surface 16 to the opposing end 15. However, it is believed that for additional strength to the top working surface and improved air and material flow during drilling, the taper of the exterior surface of the drill bit body 14 should be at least 0.020 in. from the top working surface 16 toward the opposing end 15 of the drill bit body.

The body 14 includes a pair of opposing dust collection openings 20 positioned at an angle of approximately 45 degrees with respect to a central axis 22 within the drill bit body. Accordingly, the openings 20 are angularly positioned with respect to the central axis 22 and generally diametrically centered with respect to such axis. The openings 20 are preferably of a general oval shape. However, the openings 20 may be of most any suitable shape such as circular or the like.

The dust collection openings 20 extend through recessed, generally inverted C-shaped planar side surfaces 24. The recessed planar side surfaces 24 extend parallel to one another and parallel to the vertical central axis 22 of the drill bit body 14, FIGS. 1, 2, 20 and 21 or, in another embodiment, the side surfaces 24 may taper from the top working surface 16 toward an opposing end 15 of the drill bit body, FIGS. 26–29. As shown in FIGS. 1, 2, 20, 21 and 26–29, the openings 20 provide a pair of oppositely disposed, generally transverse curved shoulder portions 26 at the lower marginal edges thereof. It will be appreciated that because the curved shoulder portions 26 are formed from the lower marginal edges of the openings 20 which are positioned at an angle of approximately 45 degrees with respect to the top portion of the central axis 22, the curved shoulder portions present an edge having a back surface 21 which slopes downwardly and inwardly toward bore 18 thereby facilitating removal of dust and the like to the bore. The shoulder portions 26 are preferably disposed at generally the midpoint of the axial length of the body 14. By this arrangement, the openings 20 are provided with a maximum cross-sectional area and are positioned substantially in the upper-half of the body 14.

The body 14 also includes a pair of oppositely disposed, upstanding members 28 which are made integral with and support the top working surface 16. The members 28 are generally arcuate in cross section and disposed in vertical planes which extend generally transverse to the planes containing the associated openings 20. The members 28 may be parallel, FIGS. 1, 2, 20 and 21 or, in another embodiment, the members 28 may taper from the top working surface 16 toward an opposing end 15 of the drill bit body 14, FIGS. 26–29.

The top working surface 16 of the drill bit body 14 has an irregular surface configuration defined by an alternating first pair of oppositely disposed tapered heel surfaces 30 and a second pair of oppositely disposed tapered compression surfaces 32. The tapered heel surfaces 30 and compression surfaces 32 of the top working surface 16 of the drill bit body 14 cooperatively allow drill dust and the like to flow into the dust collection openings 20 and through axial bore 18. As used herein an "irregular surface" represents a surface having varying distances as measured radially from a point defined by the intersection of a central vertical axis 22 of the drill bit body and a plane normal to the central axis 22 to any point defined by the intersection of the plane and the contour of the irregular surface.

As best illustrated in FIGS. 1, 2, 20, 21 and 26–29 the tapered heel surfaces 30 are positioned on opposite sides of a vertical plane that passes through the vertical central axis 22 of the drill bit body 14. The tapered heel surfaces 30 are slightly convex conical and extend downwardly and outwardly in a direction away from the vertical central axis 22 of the drill bit body 14 and provide a backup or support for the insert 12. As shown, the angle of the tapered heel surfaces 30 with respect to the upstanding members 28 of the drill bit body 14 may be of any suitable angle to prevent the top working surface 16 of the drill bit body from frictionally engaging the rock strata being drilled. In a preferred embodiment, the tapered heel surfaces 30 form an angle of approximately 25 degrees with respect to horizontal.

The tapered compression surfaces 32 are disposed on opposite sides of the vertical plane as described above such that one of the surfaces of each pair are disposed on the same side of the plane so as to merge into apex edges which lie in substantially the same general plane on opposed sides of the insert 12. The tapered compression surfaces 32 are of a substantially pie shaped concave depression and extend downwardly and outwardly away from the top of the working surface 16 of the drill bit body 14 toward the openings 20. In an alternative embodiment, the tapered compression surfaces 32 extend downwardly and outwardly to curved marginal edges terminating in openings 20 (FIGS. 20, 21 and 28, 29) to promote improved flow of air and dust, debris and the like for discharge and removal through the axial bore 18.

The tapered compression surfaces 32 are preferably disposed at a greater angle of inclination than that of the tapered heel surfaces 30. As shown, the angle of inclination of the compression surfaces 32 is greater than 20 degrees with the preferred angle being 60 degrees with respect to vertical. The lower edge of each of the compression surfaces 32 abuts with the planar vertical side surface 24 which together cooperatively act as a conduit for dust and the like to flow to the openings 20.

The dust collecting openings 20 are disposed below the tapered compression surfaces 32 such that the compression surfaces and slot 36 have a combined width wise dimension substantially equal to the corresponding transverse dimension of the respective side surfaces 24. The openings 20 are vertically spaced from the top working surface 16 by a predetermined distance such that dust and the like is automatically metered off the tapered compression surfaces 32 past the side surfaces 24 and into the dust collection openings 20. This is accomplished in a manner so as not to crowd the openings 20 thereby preventing bridging or clogging of the openings and the axial bore 18 through the drill rod.

Figure 17:
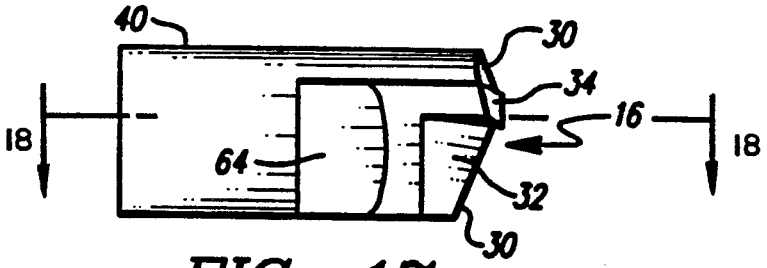
FIG. 17 is a side view of a cold headed drill bit body prior to the formation of an insert retention slot.
Figure 18:
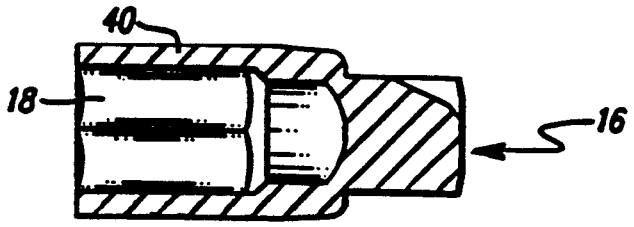
FIG. 18 is a cross sectional view of the drill bit body of FIG. 17 taken along line 18—18.
Figure 19:
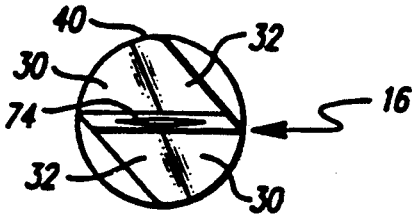
FIG. 19 is a top view of the drill bit body of FIG. 17.
Figure 24:
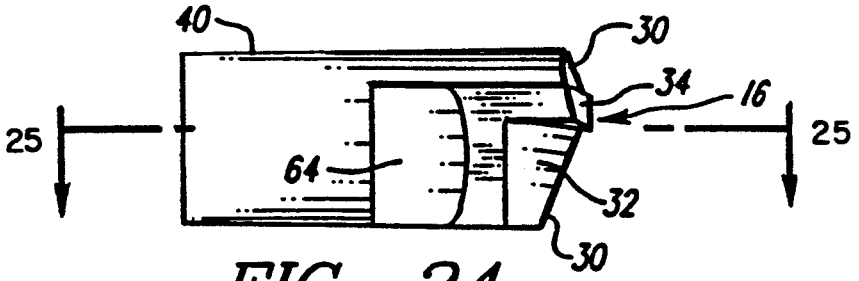
Figure 25:
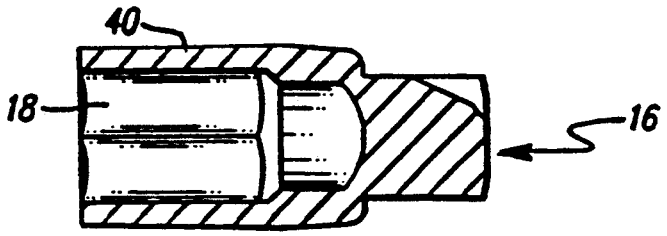
Figure 26:
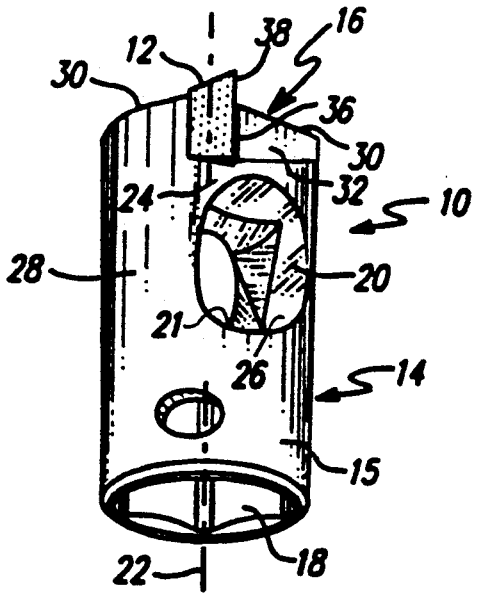
FIG. 26 is a perspective view of an alternate embodiment of a drill bit made in accordance with the present invention.
Figure 27:
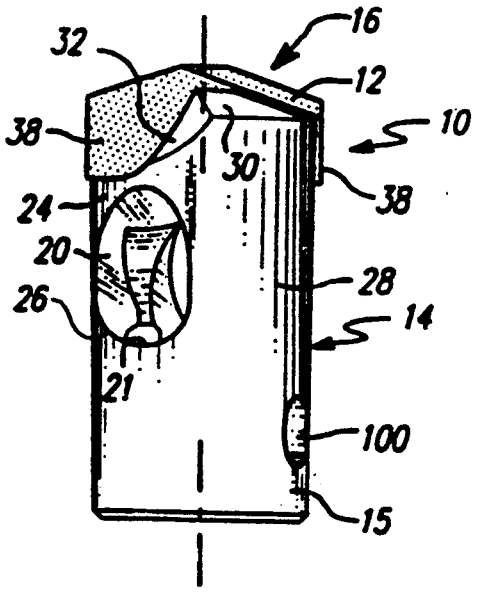
FIG. 27 is a front view of the drill bit of FIG. 26.
Figure 28:
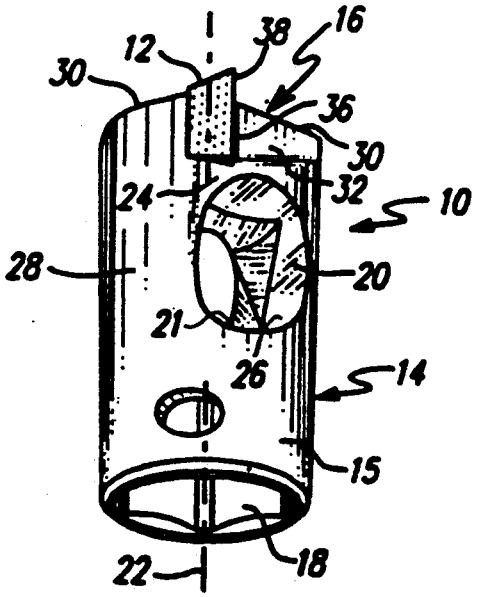
FIG. 28 is a perspective view of yet another embodiment of a drill bit made in accordance with the present invention.
Figure 29:
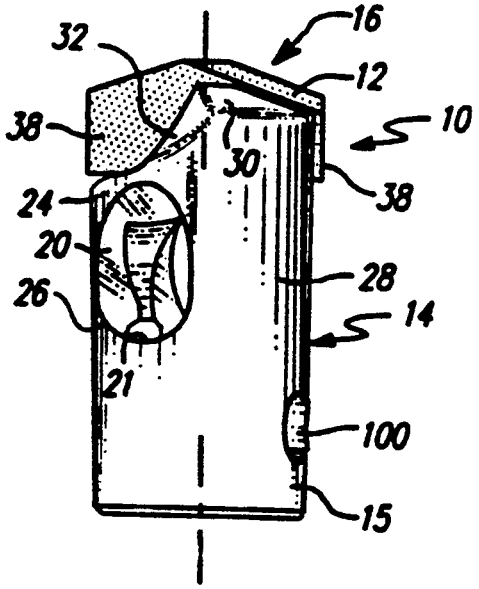
FIG. 29 is a front view of the drill bit of FIG. 28.

As shown in FIGS. 17 and 24, the multiple alternating heel and compression surfaces 30 and 32 of the drill bit 10 formed by cold heading together define a transversely extending ridge 34 which may be subsequently machined to form a groove or slot 36 to receive an insert 12 (FIG. 1, 20, 26 and 28). It will be appreciated that the multiple alternating heel 30 and compression surfaces 32 are of a shape and size to provide lateral and axial support to the insert 12 as the insert cuts the rock strata. Preferably, the sidewalls of the slot 36 for receiving the insert 12 are parallel to the vertical central axis 22 of the drill bit body.

The insert 12 secured within the slot 36 may be of a type having a plate-like configuration and made of a high strength, wear-resistant material formed of cemented tungsten carbide or the like. The insert 12 may be permanently or detachably secured within the slot 36. As shown in FIGS. 1, 2, 20, 21 and 26–29 an "A" frame house style tungsten carbide insert is secured within the slot by brazing. Braze shims such as those disclosed in U.S. Pat. No. 4,817,742 may or may not be used to braze the insert to the metal body.

The insert 12 extends laterally outwardly and beyond both ends of the slot 36 a predetermined length and over the openings 20 to provide a clearance for the drill bit body 14 as the drill bit 10 drills a hole. The exposed side surfaces 38 of the insert 12 are in general vertical alignment with the respective side surfaces 24 defining the respective openings 20 as illustrated in FIGS. 1, 20 and 26 and 28. By this arrangement, dust and the like are directed downwardly and outwardly over the compression surfaces 32 for maximum discharge. In addition, by this arrangement the symmetrically, disposed tapered heel surfaces 30 and compression surfaces 32 in conjunction with the integral members 28 provide a substantial mass of solid material to maximize the strength characteristics of the top working surface 16.

As shown the dust collecting openings 20 and side surfaces 24 lie in planes which are generally disposed parallel to the vertical central axis 22 of the drill bit 10. Accordingly, the openings 20 are disposed diametrically opposite to one another and define with the tapered heel surfaces 30 and side surfaces 24, dust collection passageways to progressively meter reduced dust material into the openings which extend parallel to one another on opposed sides of the longitudinal central axis 22 of the drill bit body 14.

The improved performance of the drill bit body 14 of the drill bit 10 in accordance with the present invention is achieved by a series of cold-heading operations now described with reference to FIGS. 4–19 and 22–25.

Figure 4:
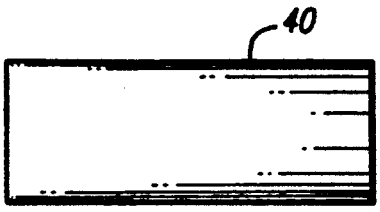
FIG. 4 is a side view of a blank from which the drill bit body in accordance with the present invention is made.

Initially, a length of wire may be drawn through a die preferably made of carbide, to a uniform diameter. The wire may then be fed into a cut-off station and pushed against a stock stop and sheared to form a blank 40 of a suitable length as shown in FIG. 4. It will be appreciated that the blank 40 may be manufactured using conventional techniques known to one skilled in the art and made of most any suitable metal such as AISI 15B35, 4140, 8630 or 8640 steels available from USX Corporation obtainable in either coil stock or rod form.

In the practice of cold-heading according to the present invention the blank diameter should be of a size smaller than the diameter of the respective coldheading die to allow for the flow of material within the die during the cold-heading process. Furthermore, it is understood that the transfer of the blank 40 from cold-heading station to cold-heading station after each successive operation may be by any means known to one skilled in the art.

Figure 6:
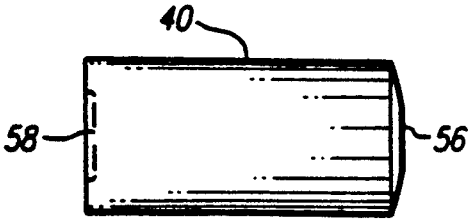
FIGS. 6, 8, and 13 are side views of successive intermediate blanks from which the drill bit body in accordance with the present invention is made.
Figure 5:
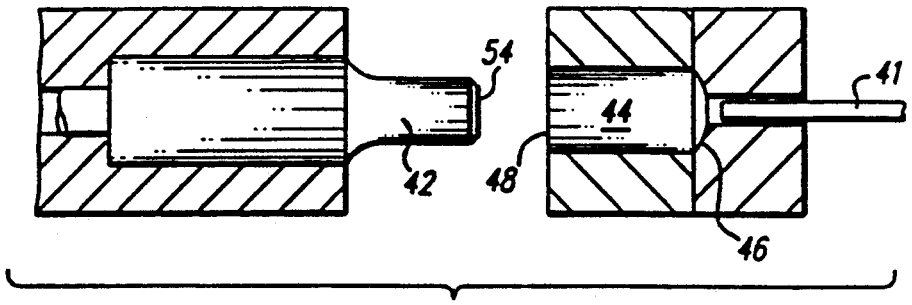
FIG. 5 is a partial cross sectional view of a punch and heading die used to form the blank of FIG. 6.

A drill bit body 14 in accordance with the present invention is produced by transferring a blank 40 as shown in FIG. 4 to a first cold-heading station as shown in FIG. 5. The cold-heading station includes a punch 42 and a complimentary die 44. The punch 42 is typically a solid cylinder sized to fit within the die 44 and includes at the forward end thereof a cylindrical cusp like projection 54 of a diameter less than the diameter of the die. The die 44 is generally a hollow cylinder having a rearward opening 48 and a forward wall having an inwardly directed convexly shaped depression 46. In operation, the blank 40 shown in FIG. 5, is forced into the die cavity 44 by the punch 42 under pressure to form a blank of uniform size as illustrated in FIG. 6. More particularly, a forward end of the blank is formed in the shape of a truncated cone 56, a first centering means shown as an annular recess 58 for centering of the blank as more fully described herein is punched within the rearward end of the blank and the cylindrical dimensions of the blank are made uniform.

Figure 7:
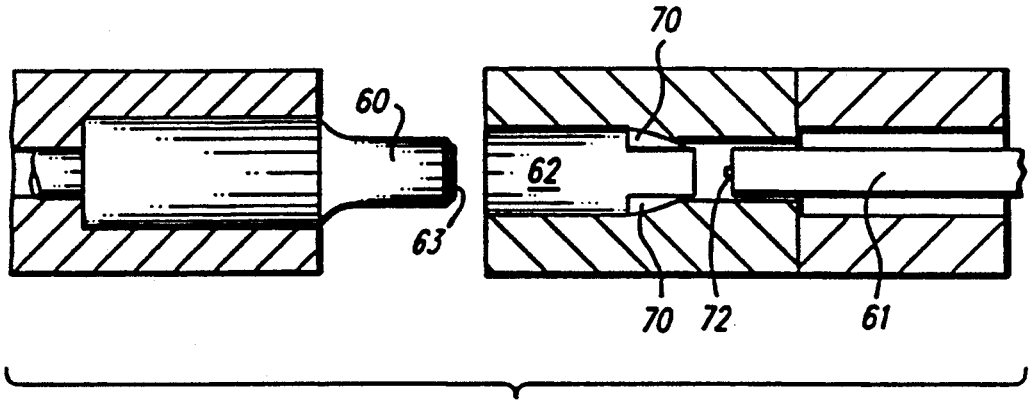
FIG. 7 is a partial cross sectional view of a punch and heading die used to form the blank of FIG. 8.

The blank 40, as shown in FIG. 6, is then removed from the die 44 by a knockout pin 41 and transferred from between the knockout pin and the punch 42 to a second knock out pin 61 and punch 60 of the cold-heading station shown in FIG. 7.

Figure 9:
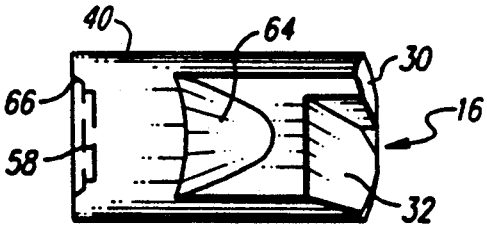
FIG. 9 is a side view of the blank of FIG. 8 rotated 90 degrees.
Figure 10:
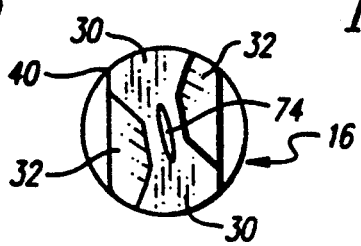
FIG. 10 is a top view of the blank of FIG. 8.

The cold-heading station of FIG. 7 includes a punch 60 and a complimentary open ended die 62. The forward end of the punch 60 includes a cusp-like projection 63 shaped to form a second centering means shown as an annular recess 66 which extends into the rearward end of the blank 40. The die 62 is of a substantially identical diameter as the die 44 of FIG. 5 and includes within the forward side walls of the die 62 two triangular-like projections 70 which form the alternating tapered heel surfaces 30 and compression surfaces 32 within the forward end of the blank as shown in FIGS. 8, 9 and 10.

In operation, the blank 40 of FIG. 6 is secured between the second knock out pin 61 and the punch 60 positioned within the first annular recess 58. The punch 60 and second knock out pin 61 cooperatively force the blank 40 into the center of the open ended die 62. As shown in FIGS. 7-10, the formation of at least two opposing recessed side surfaces 24 having tapered bullet nose or scalloped stress release surfaces 64 within the side surfaces 24 of the blank 40 and alternating tapered heel surfaces 30 and compression surfaces 32 of the top working surface 16 is initiated at the forward end of the blank and a second centering means shown as an annular recess 66 having a diameter larger than the first annular recess 58 is formed within the rearward end of the blank.

As shown in FIGS. 4, 6, 8, 13, 17, 22 and 24 as the material forming the blank 40 is displaced, the taper of the bullet nose stress release surfaces 64 decreases away from the forward end of the blank. It will be appreciated that the stress release surfaces 64 facilitate material flow and prevent die blow out and stress cracks within the blank 40. The blank 40, is then ejected from the die 62 by the knockout pin 61 having a locator boss 72 as shown in FIG. 7. It will be appreciated that the locator boss 72 forms a depression 74 within the top surface of the blank 40 to assist in the location of subsequent knockout pins for later centering operations within the cold-heading dies.

Figure 8:
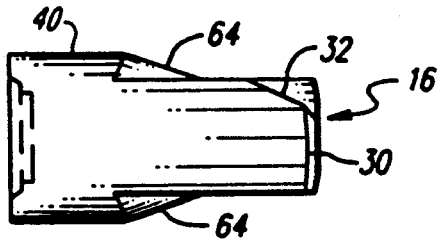
Figure 11:
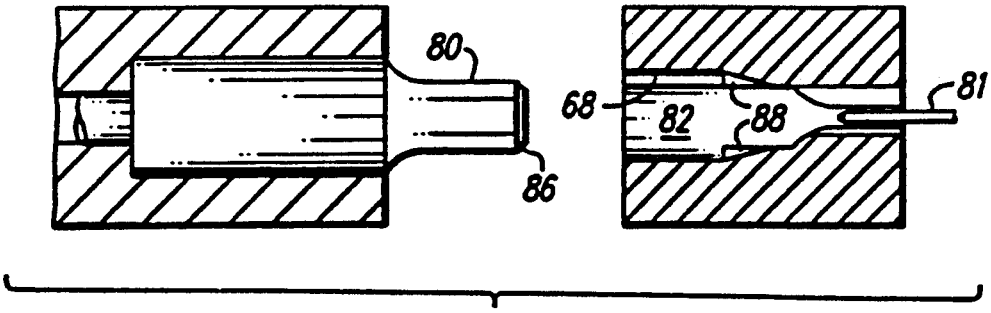
FIG. 11 is a partial cross sectional view of a heading punch and die used to form the blank of FIG. 13.
Figure 12:
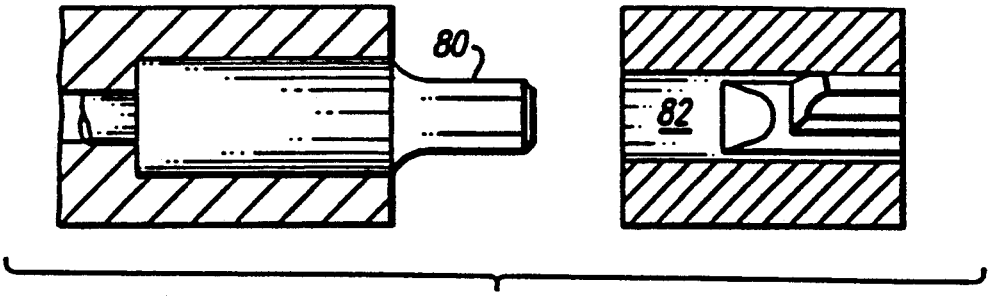
FIG. 12 is a partial cross sectional view of the heading punch and die of FIG. 11 rotated 90 degrees.

The blank 40 of FIG. 8 is then transferred to the next punch 80 and die 82 operation as shown in FIGS. 11 and 12 The blank 40 is centered within the die 82 between a third knockout pin 81 positioned within the depression 74 and a punch 80 positioned within the second annular recess 66. Within this coldheading station the material forming the blank 40 is backwardly extruded within the die 8 thereby further accentuating the features of the finished drill bit 10. The die 82 includes projecting members 68 which form the planar side surfaces 24 on directly opposing side surfaces of the blank 40 and two triangular-like projections 88 of a size larger than the immediately preceding die 62 to further form the alternating tapered heel surfaces 30 and compression surfaces 32 within the forward end of the blank. The punch 80 as shown, is a hex-shaped cylindrical rod having a frustoconical forward end 86. The punch 80 and die 82 of FIGS. 11 and 12 form an interior hex-shaped cylindrical axial bore 18 having a frustoconical forward end 86 concentric with the second annular recess 66 formed within the rearward end of the blank 40. It will be appreciated that the second annular recess 66 provides a centering means for the application of the punch 80 to the blank 40 thereby further facilitating the formation of a symmetrical blank as shown in FIGS. 13, 14, 22 and 23.

Figure 15:
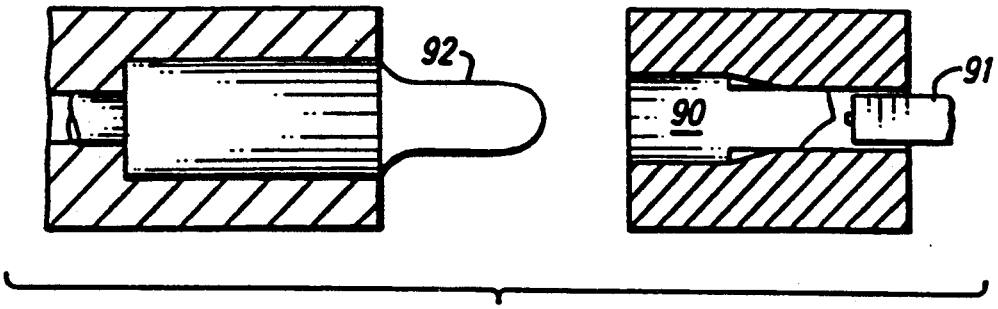
FIG. 15 is a partial cross sectional view of a heading punch and die used to form the blank of FIG. 17; .
Figure 13:
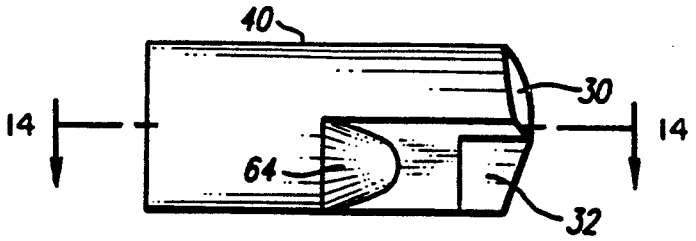
Figure 14:
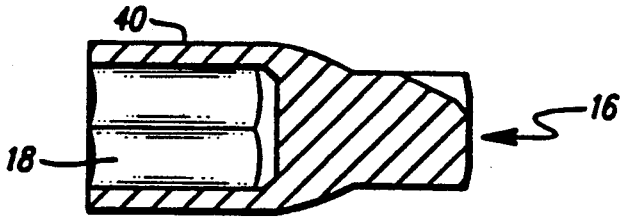
FIG. 14 is a cross sectional view of the drill bit body of FIG. 13 taken along line 14—14.
Figure 16:
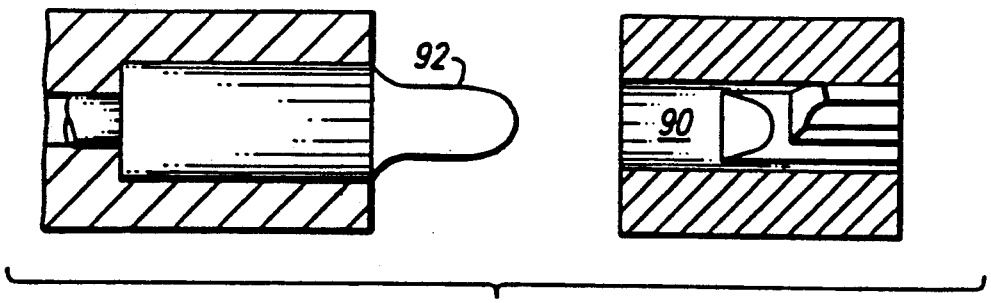
FIG. 16 is a partial cross sectional view of a heading punch and die of FIG. 15 rotated 90 degrees.

The blank 40 of FIGS. 13, 14, 22 and 23 is then transferred to the next cold-heading station, shown in FIGS. 15 and 16, wherein the axial bore 18 is formed to a desired depth and the top working surface 16 of the blank 40 is further defined. As shown in FIGS. 15 and 16, the die 90 is of approximately the same size and configuration as a finished drill bit 10 and of a size larger than die 82. The punch 92 is of a cylindrical rod shape having a spherical end. The blank 40 is centered within the die 90 between a fourth knockout pin 91 positioned within the depression 74 and the punch 92 positioned within the axial bore 18. The punch 92 and knock out pin 91 cooperatively force the blank 40 into the die 90 such that the stress release surfaces of the blank and the axial bore 18 are further elongated to the desired length.

In the manufacture of a blank 40 having tapered upstanding members 28 and side surfaces 24, the die 90 is of a size larger than die 82. As the axial bore 18 is formed, only the material forming the forward portion of the axial bore 18 conforms to the die 90 thereby providing a blank 40 having a taper which increases toward the top working surface 16 from the opposing end 15.

In the manufacture of a blank 40 having substantially parallel planar side surfaces 24 and parallel upstanding members 28, the die 90 is also of a size larger than die 82. However, die 82 contains a larger rearward portion such that during backward extrusion, the blank 40 upon exiting die 82 has a taper which decreases from the opposing end 15 toward the top working surface 16. Accordingly, as the blank 40 exits die 90 the material forming the forward portion of the axial bore 18 conforms to the die 90 thereby providing a blank 40 having substantially parallel planar side surfaces 24 and parallel upstanding members 28.

After the blank 40 is formed to the shape of the die 90 and punch 92, the blank is ejected by knockout pin 91. From these simple cold-heading operations a drill bit body 14 as shown in FIGS. 17, 18, 24 and 25 is formed.

It will be appreciated that the first and second annular recesses 58 and 66, depression 74, and axial bore 18 cooperatively provide a means for centering the blank 40 within subsequent dies by centralizing the action of the punch and die of the successive cold-heading stations on the blank thereby ensuring that the bit body 14 has uniform proportions about its central axis 22 and that the heel surfaces 30 and compression surfaces 32 are formed to the correct shape within each cold-heading station. Without the centering means the uninterrupted formation of a drill bit body 14 having an irregular top working surface would be difficult if not impossible.

Figure 30:
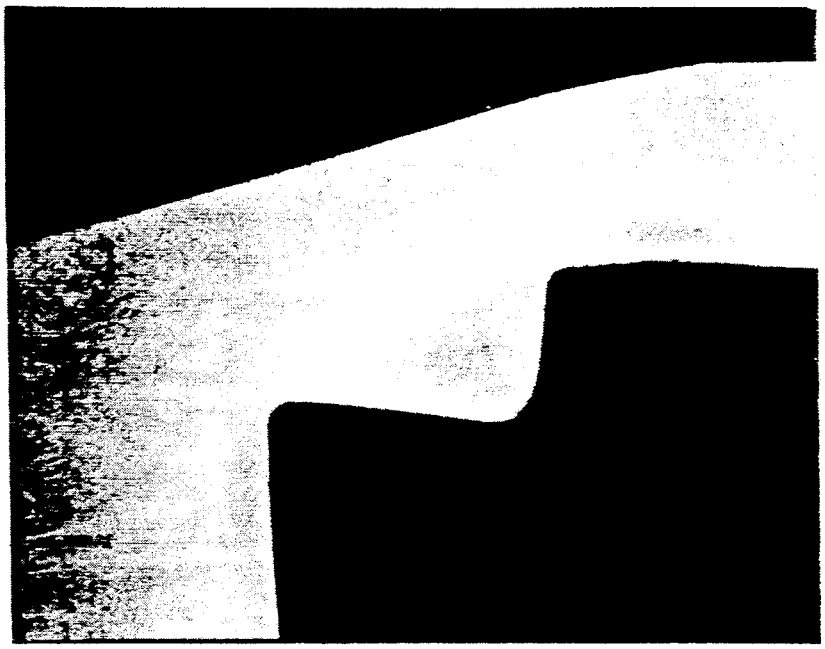
FIG. 30 is a photomicrograph illustrating the parallel metal grain structure of a polished section of a portion of a cross-section of the drill bit body of FIG. 25 (magnification 6.3X).

As shown in FIG. 30, the metal grain structure of the drill bit body in accordance with the present invention is substantially parallel with the profile or contour of the drill bit body. As a result of the parallel metal grain structure a stronger bit body, having improved toughness may be made. Furthermore, if desired, lower alloyed steels than previously possible may be used such that machining is easier and no anneal of the blank before cold-heading is required.

The dust collection openings 20 of the drill bit 10 may be formed by a suitable machining operation such as by drilling or the like. In a preferred embodiment, the dust collection openings 20 are drilled at an angle of 45 degrees with respect to the central axis 22 to provide a generally oval shaped opening. The openings 20 are drilled within the bullet nose or scalloped stress release surfaces 64 to provide access to the axial bore 18 formed within the body 14 such that the openings are in communication with the axial bore 18 to allow for the collection of dust and the like by vacuum. A retaining hole 100 may also be drilled within the body portion 14 to secure the drill bit 10 on the drill rod as previously described and known in the art. Similarly, the slot 36 may be machined into the top working surface 16 to receive the insert 12 made of a hard wear-resistant material such as cemented tungsten carbide.

In accordance with the present invention, varying insert 12 geometries such as complex and simple insert roof designs may be used by either machining or forming in the bit body an appropriately configured slot 36. The insert 12 may then be brazed into the slot 36 after which the entire bit body and insert may be heat treated.

Figure 20:
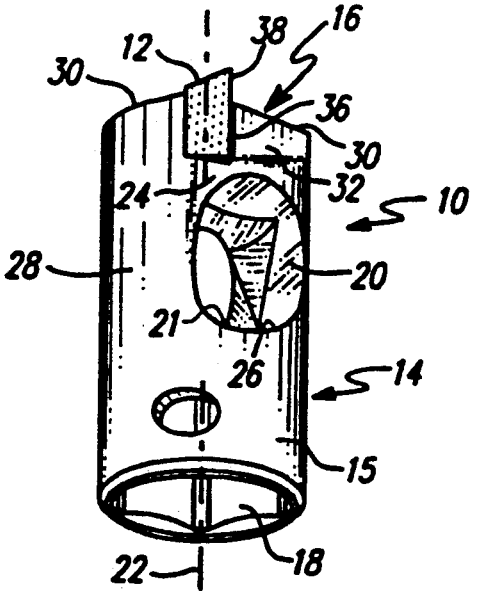
FIG. 20 is a perspective view of an alternate embodiment of a drill bit made in accordance with the present invention.
Figure 21:
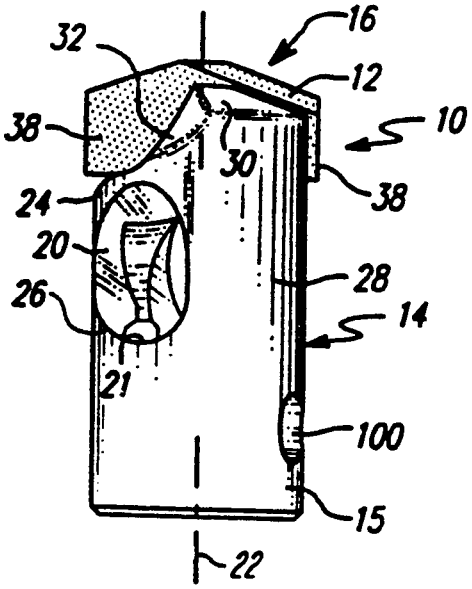
FIG. 21 is a front view of the drill bit of FIG. 20.
Figure 22:
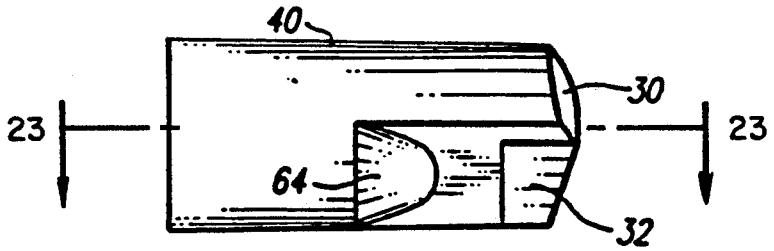
FIGS. 22 and 24 are side views of successive intermediate blanks having tapered side surfaces from which a drill bit body in accordance with the present invention is made.
Figure 23:
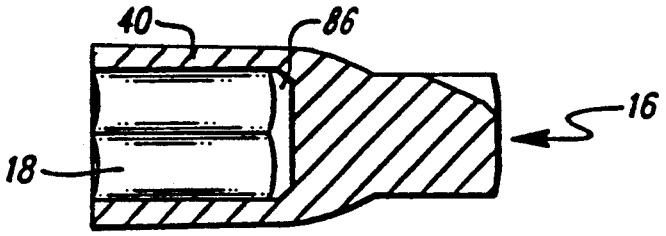
FIGS. 23 and 25 are cross sectional views of the drill bit body of FIGS. 22 and 24 taken along line 23—23 and line 25—25, respectively.

The cold-heading process allows for a wide variety of outer body portion 14 configurations to improve air flow around the upper portion of the bit 10, thereby improving evacuation of dust and the like from the cut hole. An example of a bit body portion 14 having improved air flow is illustrated in FIGS. 20 and 21. As previously described and shown in Figures 20 and 21, the tapered compression surfaces 32 extend downwardly and outwardly to curved marginal edges terminating in openings 20 to promote improved flow of air and dust, debris and the like for discharge and removal through the axial bore 18.

In a typical operation the drill bit 10, as seen in FIGS. 1, 2, 20, 21 and 26–29 is secured to the drill rod such that the bore in the drill bit is in communication with the hollow drill rod. The drill rod may then be connected to a suitable vacuum pump (not shown) to apply, a suction in the bore 18 for removal of dust and the like. The suction in the bore 18 is transmitted to the dust collection openings 20 and acts to draw the dust down across the compression surfaces 32 over the planar side surfaces 24 and into the openings 20. The dust particles are progressively reduced in size as they move across the compression surfaces of the drill bit 10 and over the side surfaces due to the downward and inward compressive forces exerted by the strata surrounding and defining the drill hole. This action, in effect, compresses the dust material against the exterior surfaces of the drill bit 10 such that the reduced material flows freely into the openings 20 for discharge through the bore 18.

It will be appreciated that the practice of the present invention is not limited to cold-heading but may include warm-heading or hot-heading. For example, in warm-heading or hot-heading the material forming the blank may be preheated such that during the heading operation the material is caused to flow within the dies at greatly reduced pressures than in the cold-heading process as described. Typical material preheat temperatures for the warm-heading process are between 1225–1275 degrees Fahrenheit and for the hot-heading process are between 2200–2350 degrees Fahrenheit.

The patents referred to herein are hereby incorporated by reference.

Having described presently preferred embodiments of the invention, it is to be understood that it may otherwise be embodied within the scope of the appended claims.

What is claimed is:

1. A drill bit for drilling holes in a work surface comprising:

(a) a hard wear-resistant insert; and (b) a metal body including a top working surface of an irregular surface configuration having a slot for retaining said hard wear-resistant insert, said body having a metal grain flow pattern substantially aligned with the contour of said body.

2. The drill bit as set forth in claim 1 wherein said body is a cold-heading body.

3. The drill bit as set forth in claim 2 wherein the exterior surface of said body is tapered from said top working surface toward an opposing end of said body.

4. The drill bit as set forth in claim 1 wherein said body includes:

(a) an interior axial bore extending upwardly through an end of said body;

(b) at least two opposing recessed inverted C-shaped planar side surfaces exterior of said body extending parallel to a central axis of said body;

(c) at least two opposing dust collection openings, each of said openings extending through a corresponding planar side surface and in communication with said axial bore;

(d) a pair of oppositely disposed transverse curved shoulder portions at the lower marginal edges of each of said respective openings; and (e) a pair of oppositely disposed upstanding members arcuate in cross-section extending between said openings.

5. The drill bit as set forth in claim 4 wherein said openings are circular and positioned at an angle of approximately 45 degrees with respect to the central axis to form a shoulder having a curved edge.

6. The drill bit as set forth in claim 4 wherein said top working surface includes an alternating first pair of oppositely disposed tapered heel surfaces and a second pair of oppositely disposed tapered compression surfaces; said slot extending transversely between said alternating pair of tapered heel surfaces and compression surfaces to receive said insert.

7. The drill bit as et forth in claim 6 wherein each of said tapered heel surfaces is of a convex conical shape extending downwardly and outwardly in a direction away from the central axis.

8. The drill bit as set forth in claim 7 wherein each of said tapered compression surfaces is of a concave depression pie shape extending downwardly and outwardly toward said opening adjoining said planar side surface.

9. The drill bit as set forth in claim 8 wherein each of said tapered compression surfaces are inclined at an angle of inclination greater than 20 degrees with respect to the central axis.

10. The drill bit as set forth in claim 8 wherein said tapered compression surfaces extend downwardly and outwardly to curved marginal edges terminating in openings to promote improved flow of air and dust and debris for discharge and removal through said axial bore.

11. A drill bit for drilling holes in a work surface comprising:

(a) a hard wear-resistant insert; and (b) a metal body formed by cold-heading including a top working surface of an irregular surface configuration having a slot for retaining said hard wear-resistant insert within said top working surface, wherein said body includes:

an interior axial bore extending upwardly through an end of said body;

at least two opposing recessed inverted C-shaped planar side surfaces exterior of said body extending parallel to a central axis of said body;

at least two opposing dust collection openings, each of said openings extending through a corresponding planar side surface and in communication with said axial bore;

a pair of oppositely disposed transverse curved shoulder portions at the lower marginal edges of each of said respective openings; and a pair of oppositely disposed upstanding members arcuate in cross-section extending between said openings.

12. The drill bit as set forth in claim 11 wherein said top working surface includes an alternating first pair of oppositely disposed tapered heel surfaces and a second pair of oppositely disposed tapered compression surfaces; said slot extending transversely between said alternating pair of tapered heel surfaces and compression surfaces to receive said insert.

13. The drill bit as et forth in claim 12 wherein each of said tapered heel surfaces is of a convex conical shape extending downwardly and outwardly in a direction away from the central axis and each of said tapered compression surfaces is of a concave depression pie-shape extending downwardly and outwardly toward said opening.

14. The drill bit as set forth in claim 13 wherein each of said tapered compression surfaces are inclined at an angle of inclination greater than 20 degrees with respect to the central axis and extend downwardly and outwardly to curved marginal edges terminating in openings to promote improved flow of air and dust and debris for discharge and removal through said axial bore.

15. The drill bit as set forth in claim 14 wherein said openings are circular to form a shoulder having a curved edge.

16. The drill bit as set forth in claim 14 wherein said openings are generally oval and positioned at an angle of approximately 45 degrees with respect to the central axis to form a shoulder having a curved edge.

17. The drill bit as set forth in claim 14 wherein the exterior surface of said body is tapered from said top working surface toward an opposing end of said body.

* * * * *